United States Patent [19]

Verdin

[11] 4,143,720

[45] Mar. 13, 1979

[54] METHOD AND APPARATUS FOR TAKING CORE SAMPLES

[76] Inventor: Sam M. Verdin, 2600 Breton Dr., Marrero, La. 70072

[21] Appl. No.: 797,248

[22] Filed: May 16, 1977

[51] Int. Cl.[2] ..... E21B 7/12

[52] U.S. Cl. ..... 175/5; 175/58; 175/84

[58] Field of Search ..... 73/170 A; 175/5, 84, 175/58, 59, 161, 220, 6

[56] References Cited

U.S. PATENT DOCUMENTS 3,874,462 4/1975 Harms ..... 175/5

*Primary Examiner*—Anthony V. Ciarlante

*Attorney, Agent, or Firm*—Cushman, Darby & Cushman

[57] ABSTRACT

In a system for obtaining core samples from a submerged bottom a core barrel and holder assembly attached at its upper end to a cable is dropped through the water from a floating vessel, and after the barrel has penetrated the submerged bottom a winch on the vessel is operated to raise the assembly into a guide tube carried by the vessel in an over-water position. An operator on the deck of the vessel swings the barrel through a vertical slot in the guide tube and as the cable is released slowly the barrel is guided to a near horizontal position so that the core sample can be removed from the barrel. The holder tilts within the guide tube during this operation but is prevented from passing through the slot, thereby preventing the assembly from swinging as a result of wave action on the vessel. The system can be used to take samples while the vessel is being propelled through the water and during rough weather.

11 Claims, 4 Drawing Figures

Fig. 1.
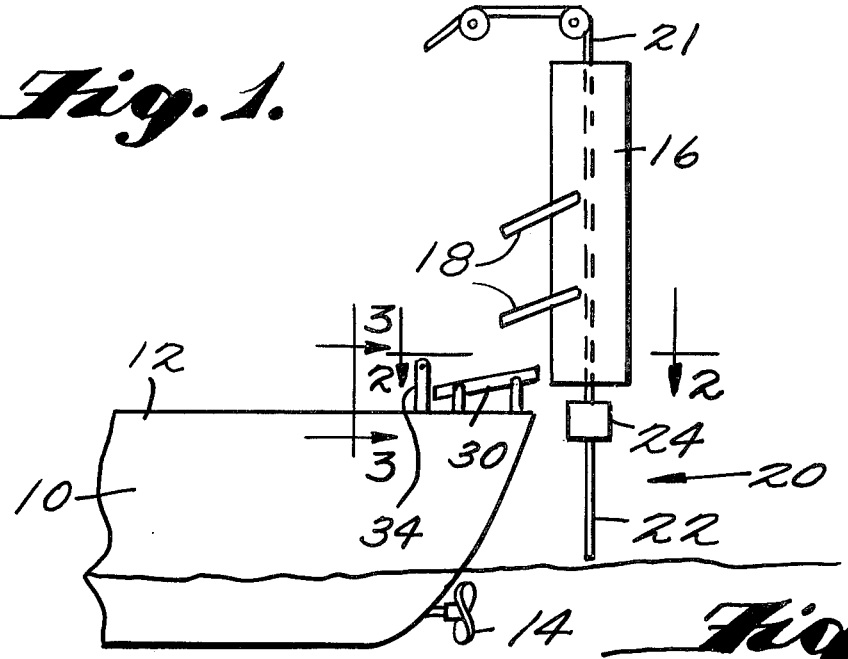
Fig. 2.
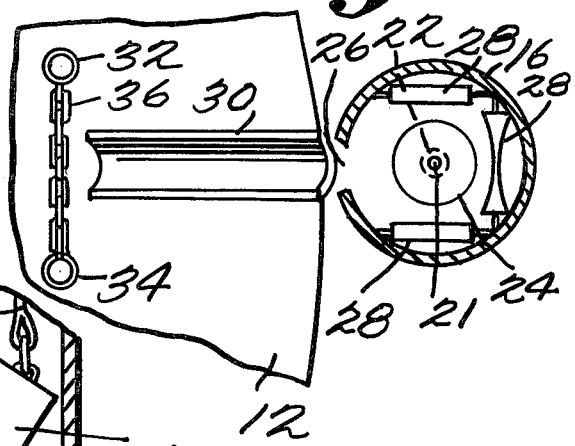
Fig. 3.
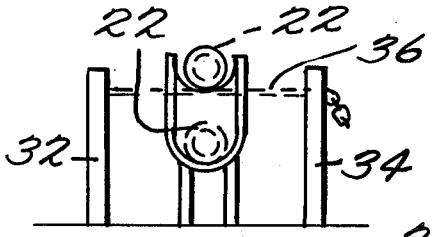
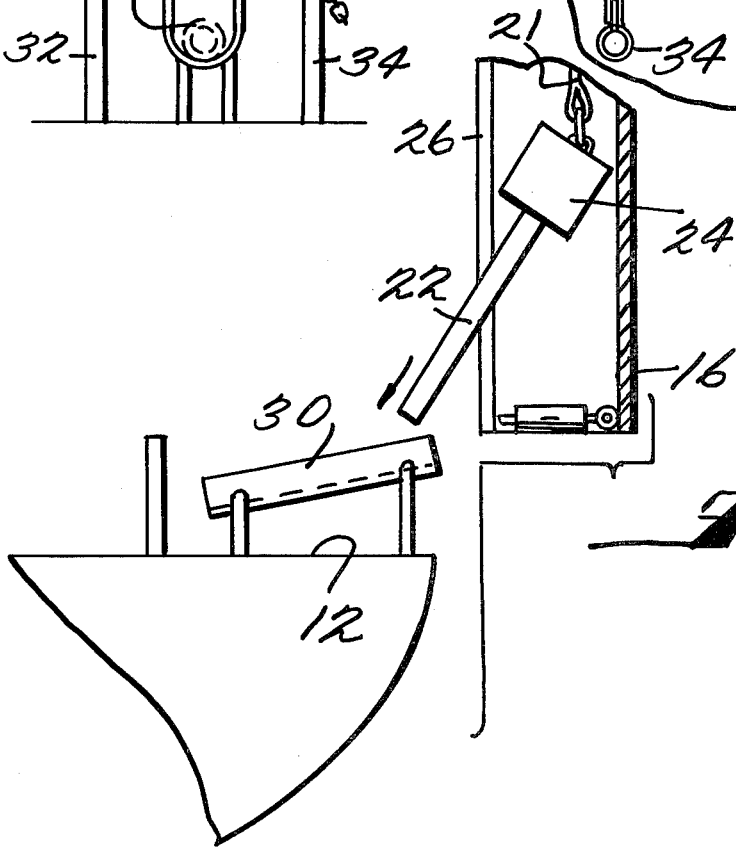
Fig. 4.

METHOD AND APPARATUS FOR TAKING CORE SAMPLES

This invention relates to apparatus and methods for taking core samples from a submerged bottom.

BACKGROUND OF THE INVENTION

Core samples of a submerged bottom can be obtained by dropping a cable-suspended core barrel from a floating vessel through the water so that the open lower end of the barrel penetrates the bottom and thereby cuts a sample which is retained in the barrel. The barrel is raised to above the surface of the water and the core sample is removed for analysis. Typically the barrel is fitted with an internal light-weight core tube which receives the sample during penetration of the bottom, and the tube and sample are removed together from the barrel. An empty tube is inserted in the barrel before the next sample-taking operation.

The core barrel assembly, being cable-suspended at its upper end, must be prevented from swinging as a result of wave action on the floating vessel. It is known to support a rigid guide tube from or on the vessel for telescopically receiving the core barrel when the latter is in a raised position and for guiding the assembly at the beginning of its free fall toward the submerged bottom.

So far as the applicant is aware prior core sampling systems have required that the vessel not be underway during the taking of a sample, due to the construction and/or location of the guide structure for the core barrel assembly. That is, the vessel needed to be stationary, in the sense of not being propelled through the water, during dropping and raising of the core barrel assembly in order to avoid entangling the cable in the screw and/or to avoid unduly high stresses in the guide structure.

SUMMARY OF THE INVENTION

According to one aspect of the present invention there is provided a specially constructed vertical guide having an internal guide passage for slidably receiving a cable-suspended core barrel assembly. The guide is supportable from a floating vessel in an over-water position and has a vertical slot facing the vessel and extending along at least the lower end portion of the guide. In operation of the system, after the core barrel assembly and its suspending cable have been dropped from the lower end of the guide so as to drive the lower end of the barrel into the bottom, the cable is hauled in to pull the barrel from the bottom and to raise the assembly into the guide passage. In this position the assembly is restrained from swinging when wave action causes movement of the vessel. In order to remove the core sample from the barrel the assembly is tilted in the guide passage so that the lower end portion of the barrel swings through the slot in the guide toward the vessel. The upper end portion of the assembly is retained within the guide passage. Then tension on the cable is released slowly so that the assembly moves downwardly, and simultaneously the lower end portion of the barrel is guided outwardly from the slot to a near horizontal position. A gutter-shaped support may be mounted on the vessel deck at a convenient height for receiving the core barrel during this operation. When the lower end of barrel is in a suitable position the cable is stopped and the sample tube containing the core sample is withdrawn from the barrel.

According to another aspect of the invention a vertical tubular guide structure for a core barrel assembly preferably but not necessarily as described above is disposed aft of the stern of a floating vessel in an over-water position. With this system it is possible to take core samples while the vessel is being propelled through the water, thereby allowing a greater bottom area to be sampled during a given time period. For example, as the core barrel assembly is being pulled from the bottom and raised toward the surface by the cable, the vessel can be propelled forwardly toward the next sample site without danger of fouling the screw with the cable. If the vessel has a relatively high speed the assembly will "water-ski" behind the vessel. The assembly can also be dropped from its guide while the vessel is underway. If the drop is unsatisfactory for any reason, the vessel may merely continue to travel in a circular path and return to the same site while the assembly is being hauled in.

DETAILED DESCRIPTION OF THE INVENTION

The invention will be further understood from the following detailed description taken with the drawings in which:

FIG. 1 is a schematic elevational view of the stern of a vessel fitted with a core sampling system embodying the principles of the present invention;

FIG. 2 is a sectional view taken on the line 2—2 in FIG. 1;

FIG. 3 is a fragmentary view looking in the direction of the arrows 3—3 in FIG. 1; and FIG. 4 is a fragmentary sectional view showing the core barrel assembly tilted in the guide tube.

FIG. 1 shows the stern portion of a floating vessel 10 having a deck 12 and a screw 14. Supported from the deck 12 in an over-water position after of the stern is a vertical guide pipe 16 having open ends. For ease of illustration the support braces 18 are broken away. Loosely slidable through the guide pipe is a core barrel assembly 20 suspended at its upper end from a cable 21 which extends to a power-operated winch (not shown). The core barrel assembly 20 includes a core barrel 22 which may be conventional, and a holder 24 for the barrel. The barrel 22 has an open lower end and is fitted with an internal removable tube (not shown) which receives the sample when the barrel 22 forces itself into the submerged bottom.

The guide pipe 16 has a vertical slot 26 facing forward, that is facing the vessel, and extending at least along the lower end portion of the guide pipe. The slot 26 is wide enough to allow the core barrel 22 to pass through but is too narrow to allow the holder 24 to pass. The inside diameter of the guide pipe 16 is large enough to allow the holder 24 to tilt to a horizontal position. The lower end of the guide pipe 16 carries three transversely disposed rollers 28 each of which is mounted on the pipe 16 for rotation about its own axis. The rollers 28 prevent the cable 21 from cutting or otherwise damaging the pipe 16 when the core barrel assembly 20 is below and offset from the pipe 16.

A trough 30 is supported on the deck 12 of the vessel 10 in a position radial to the guide pipe 16 at the location of the slot 26 in the latter. The trough 30 is inclined downwardly and forwardly so that it can receive the lower end of the core barrel 22 when the latter is swung through the slot 26 in the guide pipe 16 by an operator standing on the deck. The core barrel 22 should be horizontal or nearly so for easy removal of its inner tube by the operator. A simple lifting arrangement is provided in the form of two posts 32 and 34 located just forwardly of and on opposite sides of the lower end of the trough 30 and a chain 36 secured at one end to one post 32 and releasably attachable to the other post 34 as by being inserted in a slot 38 in the upper end of the latter. In order to lift a core barrel 22 to a near horizontal position the operator manually loops the chain 36 under the end of the core barrel 22 projecting beyond the end of the trough 30 lifts on the free end portion of the chain 36 and then attaches the free end portion of the chain 36 to the post 34.

The guide pipe 16 may be for example a 24 inch diameter pipe with a 7 inch slot 26. The core barrel 22 may be 6 inches in diameter and the holder 24 may be 18 inches in diameter.

In operation of the system the core barrel assembly 20 is dropped, along with its attached cable 21 from its FIG. 1 position so that it will free-fall through the water and embed the core barrel 22 in the submerged bottom. This can be done with the vessel 10 either stationary or moving forwardly through the water. As soom as the cable 21 runs slack the winch is operated to tension the cable 21, pull the barrel 22 from the bottom and begin hauling in the core barrel assembly 20. The vessel 10 may speed up at this time if it is desired to proceed rapidly to the next sampling site, perhaps three miles away. The core barrel assembly 20 will trail behind the vessel 10 either in the water or, if the vessel speed is high, on top of the water "water-ski" fashion. There is no danger of fouling the screw 14 with the cable 21 as the cable 21 will trail away from the stern. The cable 21 will engage one of the rollers 28 during this operation.

When the core barrel assembly 20 is raised into the guide pipe 16 the wall of the latter prevents the assembly 20 from swinging because the holder 24 cannot pass through the slot 26. Motion of the vessel 10 by the waves, even during rough weather, therefore, does not interfere with the sampling operation. When the lower end of the core barrel 22 arrives at a position above the rollers 28 the winch is stopped, and an operator with a hand-held hook grasps the barrel 22 and swings it through the slot 26. The holder 24 tilts within the guide pipe 16 and continues to present uncontrolled swinging of the assembly 20 due to motion of the vessel 10. When the lower end of the barrel 22 is over the trough 30 the winch is released slowly. The end of the barrel 22 engages the trough 30 and with more guiding by the operator begins to slide forwardly along the trough 30. When the end of the barrel 22 projects a short distance beyond the end of the trough 30 the winch is stopped. The operator lifts the end of the barrel 22 to a near horizonal position with the loop of chain 36 and attaches the chain 36 to the post 34 so as to hold the barrel 22 in position. The core tube within the barrel 22 is then removed by sliding it out of the barrel 22 and a new tube is inserted. The winch is tensioned to pull the assembly 20 upward so that the barrel 22 slides up the trough 30 and then swings through the slot 26 and into the guidepipe. Another drop can now be made.

What is claimed is:

1. In a system for taking a core sample from a submerged bottom:

an elongated vertical guide supportable by a floating vessel in an over-water position, said guide having an internal vertical guide passage open at its lower end and a vertical slot communicating with said passage and extending along at least the lower end portion of said guide;

a core barrel assembly suspendable at its upper end from a cable, said assembly being loosely slidable in said guide passage and including a core barrel having a lower end adapted to penetrate the submerged bottom, said core barrel having a width dimension less than that of said slot whereby tilting of said assembly while cable-suspended in said guide passage permits said core barrel to pass through said slot for servicing by an operator;

and means preventing the upper end portion of said assembly from passing through said slot whereby said guide prevents uncontrolled swinging of the cable-supported assembly resulting from wave action on the vessel.

2. A system as in claim 1 including transverse rollers disposed at the periphery of the lower end of said guide passage for engagement by the cable when said core barrel assembly moves into or out of said guide passage.

3. A system as in claim 1 including an elongated support having an upwardly facing trough-shaped surface positioned adjacent said slot in said vertical guide for receiving said core barrel when the latter is swung through said slot in said guide.

4. In a system for taking core samples from a submerged bottom:

a core barrel assembly suspended at its upper end from a cable, said assembly including a core barrel having a lower end adapted to penetrate the submerged bottom; a vertical guide tube supported by a floating vessel in an over-water position which is fixed relative to the vessel, said guide tube having a vertical slot extending along at least the lower end portion thereof, the internal diameter of said tube being larger than the diameter of said core barrel assembly and the width of said slot being wider than the diameter of said barrel, said barrel assembly including a portion of enlarged diameter which is tiltable within the guide tube to permit said barrel to swing through said slot and which is of a size preventing passage of said portion through said slot.

5. A system as in claim 4 including an elongated support having an upwardly facing trough-shaped surface positioned adjacent said slot in said guide tube for receiving said core barrel when the latter is swung through said slot.

6. In a method of obtaining a core sample from a submerged bottom by dropping a core barrel assembly, attached at its upper end to a cable, from a floating vessel so that the assembly free falls through the water to embed its lower end in the bottom and thereby take a core sample from the bottom, the improvement comprising raising the assembly into a vertical guide structure carried above water level by the floating vessel; tilting the assembly in the guide structure to cause the lower end portion of the assembly to pass through a vertical slot in the guide structure while the upper end portion is retained in the guide structure; and removing the core sample from the lower end of the assembly.

7. A method as in claim 6 including the step of lowering the core barrel assembly after it has been tilted and simultaneously guiding the lower end portion of the assembly to move laterally away from the vertical guide structure.

8. A method as in claim 7 wherein the lower end of the vertical guide structure is positioned above the level of the deck of the vessel and wherein the lower end portion of the core barrel assembly is guided on to an elongated support structure carried on the deck.

9. A method as in claim 6 wherein the vertical guide structure is positioned aft of the floating vessel and wherein after the lower end portion of the core barrel assembly has become embedded in the submerged bottom the vessel is moved through the water toward another location as the assembly is being raised.

10. In a system for taking core samples from a submerged bottom by means of a core barrel assembly the lower end of which penetrates the submerged bottom and the upper end of which is suspended from a cable, the improvement comprising: guide means mounted on a floating vessel in an above-water position for cooperating with the core barrel assembly in a manner to prevent the assembly and suspending cable from swinging as a result of wave action on the vessel while permitting the assembly to be tilted relative to the cable to a generally horizontal position in which the lower end of the assembly can be serviced, said guide means including a vertical tube-like structure for surrounding the assembly, said structure having a slot through which the lower end of the assembly can be tilted.

11. A system as in claim 10 including a guide having an inclined upper surface mounted adjacent said tube-like structure to receive the lower end of the assembly when tilted relative to said structure.

* * * * *